US007374814B2

(12) United States Patent
Kamiya et al.

(10) Patent No.: US 7,374,814 B2
(45) Date of Patent: May 20, 2008

(54) SOFT MAGNETIC POWDER MATERIAL CONTAINING A POWDERED LUBRICANT AND A METHOD OF MANUFACTURING A SOFT MAGNETIC POWDER COMPACT

(75) Inventors: Naoki Kamiya, Chiryu (JP); Wataru Yagi, Nagoya (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 258 days.

(21) Appl. No.: 11/073,735

(22) Filed: Mar. 8, 2005

(65) Prior Publication Data

US 2005/0205848 A1 Sep. 22, 2005

(30) Foreign Application Priority Data

Mar. 22, 2004 (JP) ..... 2004-083212
Nov. 22, 2004 (JP) ..... 2004-338080

(51) Int. Cl.
*B32B 5/16* (2006.01)

(52) U.S. Cl. ..... 428/403; 428/407; 428/689; 428/699; 428/704

(58) Field of Classification Search ..... 428/403, 428/407
See application file for complete search history.

(56) References Cited

U.S. PATENT DOCUMENTS 4,833,040 A 5/1989 Fishman et al.
5,607,768 A * 3/1997 Lee ..... 428/403
5,963,771 A * 10/1999 Chan et al. ..... 419/2
6,723,179 B2 * 4/2004 Yagi et al. ..... 148/300
7,033,413 B2 * 4/2006 Iyoda et al. ..... 75/252

FOREIGN PATENT DOCUMENTS

| | | |
|---|---|---|
| JP | 2002-280209 | 9/2002 |
| JP | 2002-329626 | 11/2002 |
| JP | 2003-183702 | 7/2003 |
| WO | WO 98/38655 | 9/1998 |

OTHER PUBLICATIONS

Ichiro Takasu, et al, "Improvement of the sintering process in a Sendust alloy powder used as a magnetic recording head material." Journal of Magnetism and Magnetic Materials, XP-004065753, vol. 163, No. 3, Nov. 1996, pp. 397-400.

* cited by examiner

*Primary Examiner*—H. T Le
(74) *Attorney, Agent, or Firm*—Oblon, Spivak, McClelland, Maier & Neustadt, P.C.

(57) ABSTRACT

A soft magnetic powder material includes an iron powder, and a plated layer formed on a surface of the iron powder and possessing a lubricating property. The plated layer includes a lubricant material and a matrix in which the lubricant material disperses. The soft magnetic powder material is manufactured by an electroless deposition process, by which a plated layer is formed by depositing, on a surface of an iron powder, at least one element building a matrix, along with a micro-powdered lubricant material.

12 Claims, 5 Drawing Sheets

SOFT MAGNETIC POWDER MATERIAL CONTAINING A POWDERED LUBRICANT AND A METHOD OF MANUFACTURING A SOFT MAGNETIC POWDER COMPACT

CROSS REFERENCE TO RELATED APPLICATIONS

This application is based on and claims priority under 35 U.S.C. §119 with respect to Japanese Patent Applications 2004-83212, filed on Mar. 22, 2004, and 2004-338080, filed on Nov. 22, 2004, the entire content of which is incorporated herein by reference.

FIELD OF THE INVENTION

This invention generally relates to a soft magnetic powder material. More particularly, this invention pertains to a method of manufacturing a soft magnetic powder compact.

BACKGROUND

Recent attentions have focused on a powder molding method, whereby a powder made from a soft magnetic material (hereinafter, referred to as a soft magnetic material powder) mixed with a resin is compression-molded, and is then heat-treated (i.e., curing method). The soft magnetic material powder can, for example, be made from an iron powder of a high degree of purity. Moreover, particles of the soft magnetic material powder can be coated with insulating films on surfaces thereof. As a resin to be mixed in the soft magnetic material powder, it is preferable that the resin possesses properties such as a behavior as a binder and for insulating at gaps of the soft magnetic material powder particles. A soft magnetic material powder compact molded as described above is employed for a motor core having a rotor and a stator.

More specifically, recent attentions have focused on some of the benefits which can be obtained, with high contribution, from the powder molding method: (1) expanding a possibility of shape design, downsizing a molded component (i.e., a compact), and cost reduction in manufacturing a compact; (2) improving a material yield ratio, and cost reduction in manufacturing a compact; (3) a simple process and cost reduction in manufacturing a compact; and (4) improving a material recycling efficiency so that an environment and resource can be conserved.

On the other hand, considerations should be given to points which should be improved about the powder molding method: (1) difficulty in assuring mechanical strength of a compact, especially at a high temperature atmosphere; (2) special design applied to a die, the special design which can facilitate a compact, to be taken out, or, to be ejected from the die; and (3) a magnetic property being inferior to the one of a pure iron plate.

In order to improve the aforementioned points of the powder molding method, JP2003-183702A discloses that a mixture of a polyamide based resin with a lubricating property, a polyphenylene sulfide resin (PPS) with a high melting point, and a soft magnetic material powder can contribute, at a high temperature atmosphere such as 200 degrees Celsius, to improvement of strength of a compact made from the mixture. However, recent requirements have led to a compact, which can possess a high degree of strength at a higher temperature atmosphere.

JP2002-329626A discloses, in order to enhance strength and a magnetic property of a compact, a method of applying a lubricant, such as a lithium stearate, at an interior of a die, thereby enabling to mold a compact with a material not including resin material. However, in this method, a process of applying a lubricant at an interior of a die is essentially required. In such circumstances, it has been found that there is a danger of lowering productivity of a compact, and of undesirably increasing a molding cost, especially when a lubricant is required to a complicatedly shaped die. Accordingly, the method of applying a lubricant at an interior of a die disclosed herein may not be readily applied to industrial uses.

JP2002-280209A discloses a technology, whereby a compact is made from a mixture of a thermosetting resin, a lubricant and an iron, the compact can possess, in favor of a thermosetting resin, a sufficient degree of mechanical strength at a high-temperature atmosphere, and, in favor of a lubricant, a sufficient degree of lubricating property. However, it has been found that a remaining lubricant may become a source of corruption of the compact, and moreover the remaining lubricant may permeate outside.

The present invention has been made in view of the above circumstances, and provides a soft magnetic powder material, which can be readily molded, can assure a high degree of strength of a compact at a high temperature atmosphere, and is excellent at a magnetic property. Moreover, the present invention provides a method of manufacturing a soft magnetic powder compact made from the aforementioned soft magnetic powder material.

SUMMARY OF THE INVENTION

According to an aspect of the present invention, a soft magnetic powder material includes an iron powder, and a plated layer formed on a surface of the iron powder and possessing a lubricating property. It is preferable that the plated layer includes a lubricant material and a matrix in which the lubricant material disperses.

According to another aspect of the present invention, a soft magnetic powder material is manufactured by an electroless deposition process, by which a plated layer is formed by depositing, on a surface of an iron powder, at least one element building a matrix, along with a micro-powdered lubricant material.

It is preferable that an insulating coating is formed on the surface of the iron powder, and wherein the plated layer is formed on the insulating coating formed on the surface of the iron powder.

According to a further aspect of the present invention, a method of manufacturing a soft magnetic power compact includes the steps of: obtaining a soft magnetic powder material by depositing, on a surface of an iron based powder, a plated layer in which a micro-powdered lubricant material disperse in a matrix; molding, by means of a die, a green compact made from the soft magnetic powder material; and applying a heat-treatment to the green compact.

It is preferable that the step of applying the heat-treatment to the green compact is implemented under an oxidizing atmosphere. In such a case, it is possible to bond interfaces in the soft magnetic powder material, even under a relatively low temperature. Therefore, it is possible to restrain a degree of influence of the heat-treatment that may be subjected to the plated layer and the insulating coating.

It is still preferable that the step of applying the heat-treatment to the green compact is implemented under an inert atmosphere, and is a step of bonding interfaces in the plated layer. In such a case, it is possible to bond interfaces in the soft magnetic powder material under with high reliability even under a relatively low temperature.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
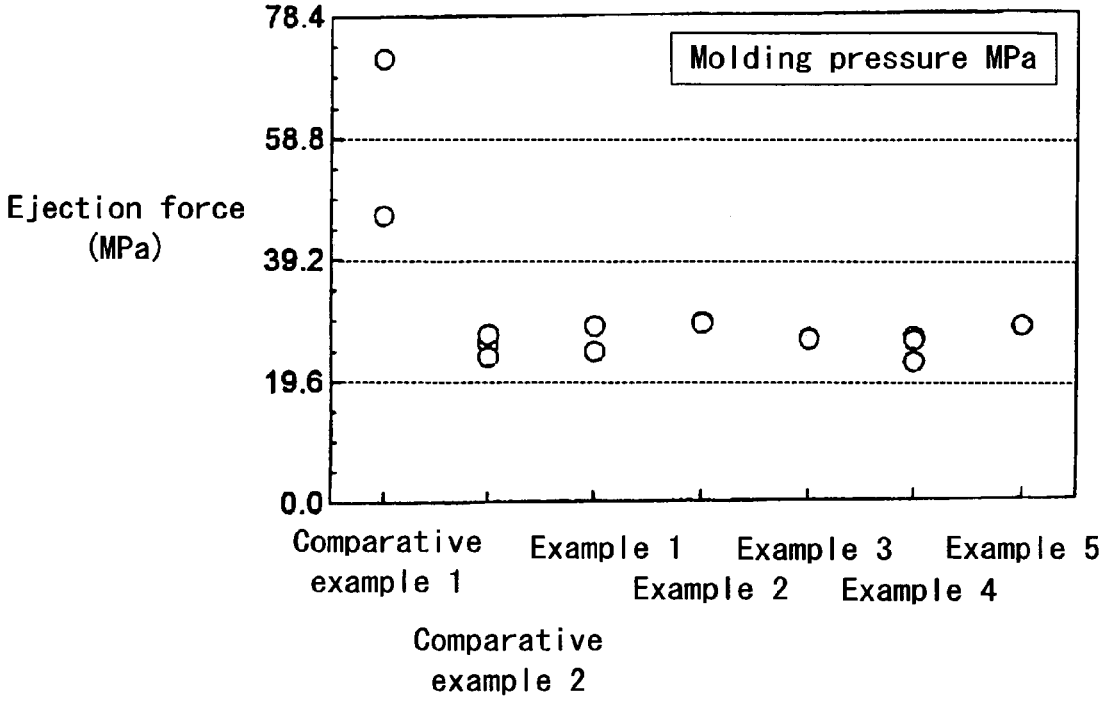
FIG. 1 is a diagram for explaining a degree of ejection force for molding a green compact by Test 1 according to an embodiment of the present invention.

Embodiment of the present invention will be described hereinbelow in detail with reference to the accompanying drawings.

"Soft Magnetic Powder Material"

A soft magnetic powder material according to embodiment of the present invention is a composite powder mixed with an iron powder and a plated layer formed on a surface of the iron powder.

The iron powder is made from a powdered iron material. The iron powder can on occasions be formed with an insulating coating on a surface thereof. The particle sizes of the powder particles are not specifically limited, but, preferably, the particle size of the powder particles may range from 10 μm to 300 μm, particularly 50 μm to 200 μm. The powder made from an iron material can be manufactured by a conventional method, such as a gas atomizing method and a water atomizing method. A shape of the iron powder is not limited.

It is preferable that the iron material possesses a high degree of magnetic property. For example, the iron powder is preferably made from an iron material such as iron-rich based material, or from an iron family material including at least one of alloying elements of Si, Al, Ni, Co, etc., e.g., iron-silicon (Fe—Si) based alloy, iron-silicon-aluminum (Fe—Si—Al) based alloy, iron-nickel (Fe—Ni) based alloy and iron-cobalt (Fe—Co) based alloy. It is desirable that the iron material powder particles possess crystal grains, each of which has a large crystal grain diameter. For example, on the assumption that crystal grains in a single metal powder particle are specified on the basis of a different standard, an average crystal grain diameter in a single metal powder particle can be measured by "*Method of Ferrite Grain Size Test for Steel*" specified in JISGO552, and the average crystal grain diameter which is appropriate for the embodiment of the present invention, can correspond to the crystal grain diameter determined with a grain size number 5, or, a greater crystal grain diameter of the grain size number 5. Moreover, it is preferable that each of the powder particles, when cross-sectioned, has no greater than ten crystal grains on average. The number of crystal grains can be adjusted by means of a heat-treatment.

When a surface of each iron powder particle is coated with an insulating coating, a composition of the insulating coating is not specified. As an insulating coating for the iron powder, for example, coatings such as a phosphoric coating, a ferrite coating, an inorganic material coating containing $SiO_2$, and an inorganic material coating containing $Al_2O_3$, can be selectively employed. A method of manufacturing an insulating coating and a thickness of the insulating coating are not specifically defined, and conventional methods and structures thereof can be employed.

A plated layer according to the embodiment of the present invention possesses a lubricating property, and can be built with a lubricant material and a matrix, in which the lubricant material disperses.

When a lubricant material is incorporated in the plated layer, the amount of the lubricant material is not specifically limited, and, preferably, is within a range of substantially 2-40 mass % on the basis of an entire mass of the plated layer. The amount of the lubricant material added into the plated layer can on occasions be determined depending on whether a sufficient degree of ejection force can be attained at the time of molding a powder, or otherwise. A lubricant material is not specifically defined, and lubricant materials conventionally used for a powder molding can be selectively employed. Specifically, it is preferable that a lubricant material is elaborated with a single compound, or with a mixture of compounds, selected from among polytetrafluoroethylene (PTFE), molybdenum disulfide, boron nitride, thermoplastic resin, and graphite.

According to the embodiment of the present invention, because a lubricant material disperses in a matrix, a melting point and a softening point of the lubricant material is much less sensitive to strength of a final soft magnetic powder compact at a high-temperature ambiance. However, it is preferable that the lubricant material be made from a material, which does not melt, and is not softened, at a working temperature of a soft magnetic powder compact. Moreover, it is preferable that the lubricating material be powdered finely so as to have a preferable particle diameter, e.g., substantially 0.01-1.0 μm.

In general, a matrix can build a plating with itself. According to the embodiment of the present invention, it is preferable that the matrix be made from a material which can deposit, by means of an electroless deposition method, as a matrix. As the material which can deposit by means of an electroless deposition method, electroless deposition materials, such as NiP, NiWP, NiMoP, NiReP, NiB, NiWB, NiMoB, CoP, CoNiP, CoZnP, CoNiReP and CoB, can be selectively employed so as to elaborate a matrix.

A method of forming a plated layer is not specifically limited. For example, a plated layer with the matrix can be formed on a surface of each iron powder particle, by immersing the aforementioned iron powder in a solution, which contains an ion and a reducing agent, both of which are selected depending on at least one element which constitutes a matrix. As required, the solution can additionally contain a complexing agent, a buffering agent and a stabilizer. In such circumstances, by additionally suspending a lubricant material at a predetermined amount in the solution, the lubricant material can disperse within the plated layer.

Hereinafter, a condition, in which the lubricant material disperses within the matrix, corresponds to a condition, in which both the lubricant material and the matrix disperse and are adhered at a surface of each iron powder particle. As an ideal condition, a single lubricant material, or multiple lubricant materials, disperses within the matrix, and the matrix fills interfaces, or gaps, of the lubricant material, or of the multiple lubricant materials.

It is preferable that the thickness of the plated layer is no greater than substantially 20 μm, more preferably no greater than substantially 10 μm, and still more preferably no greater than substantially 5.0 μm. A lower limit of the thickness of the plated layer is not specifically limited. However, it is preferable that the thickness of the plated layer be as small as possible, placing the limit at which a degree of ejection force for the power molding, and a magnetic property such as iron loss, are controlled at respective predetermined ranges. Specifically, the thickness of the plated layer can be, for example, 0.1 μm or greater than that.

It is preferable that the plated layer includes an elemental phosphorous at 10 w % or more on the basis of an entire weight of the plated layer. As far as the content of the elemental phosphorous is controlled within the aforementioned density range, an electric conductivity of the plated layer can be effectively reduced. In this case, in terms of improvement in a magnetic property of the plated layer, it is preferable that the content of the elemental phosphorous within the plated layer be substantially equal to a solubility limit or less.

"Method of Manufacturing A Soft Magnetic Powder Compact"

A method of manufacturing a soft magnetic powder compact according to the embodiment of the present invention includes a molding process and a heat-treating process.

In the molding process, the aforementioned soft magnetic powder material is employed so as to obtain, by means of a die, a green compact with a desired shape. A molding condition is not specifically defined, and a commonly used molding condition can be applied. As described above, the aforementioned soft magnetic powder material possesses a high lubricating property. Therefore, even if a molding pressure is set at a high degree, there is less danger of the green compact of excessively interfering with the die when being molded and die-cut.

In the heat-treating process, it contributes to bonding interfaces in the soft magnetic powder material, by heating up a green compact molded through the molding process. A heat-treating condition is not specifically defined, and is preferably within a range of substantially 100° C. to 900° C. Especially, in order to protect an insulating coating coating a surface of the iron powder, a possible low temperature, such as 100° C. to 400° C., and 250° C. to 350° C. can be preferably employed. Moreover, if the heat-treating process is implemented at an oxidizing atmosphere (e.g., heating in an air), it is possible, even at a relatively low temperature, such as substantially 500° C. or less, to bond the interfaces in the soft magnetic powder material to a high degree of strength. Although the details on the heat-treating process at an oxidizing atmosphere have not been clarified yet, the inventors assume that the iron power material particles are bonded or connected with one another by means of oxides generated at the interfaces of the iron power particles. Therefore, because adhesive effect, which is exerted by fusion of the lubricant material, is not employed for the aforementioned iron material powder, there is less danger, even at a high temperature atmosphere, of a degree of strength of a soft magnetic powder compact of being reduced.

Moreover, the heat-treatment process can be implemented at an inert atmosphere, such as a nitrogen-gas atmosphere, and an argon-gas atmosphere. In such circumstances, diffusion bonding is progressed at openings which are not sufficiently bonded in the plated layer and the iron powder, wherein it is possible to bond, with high rigidity, interfaces in the soft magnetic powder material, in favor of diffusion bonding. Moreover, by increasing a heating temperature up to a melting point or a softening point of the lubricant material, or of the matrix, or by increasing a temperature over the melting or softening point thereof, it is possible to bond the interfaces in the soft magnetic powder material by the molten or softened lubricant material. In such a case, it is preferable that the matrix and the lubricant material both of which configure the plated layer, possess respectively melting points and softening points which are greater than an operating temperature of a soft magnetic powder compact.

Having generally described this invention, a further understanding can be obtained by reference to certain specific examples which are provided herein for purposes of illustration only, and are not intended to be limiting unless otherwise specified.

Test 1:

Manufacturing of Test Powder Material

EXAMPLE 1

A plated layer, which contains, PTFE powder (average particle size 0.2 μm) as a lubricant material, and a compound NiP as a matrix, is formed on each iron powder particle (average particle size 200 μm, SOMALOY550 from Höganäs) covered with an insulating coating. The plated layer is formed by an electroless deposition method. The thickness of the plated layer is 0.1 μm, and the content of the PTFE powder is defined at substantially 20 volume % on the basis of the volume of the plated layer. A soft magnetic powder material, which is obtained with the aforementioned material by the aforementioned method, is employed as a test powder material according to the Example 1 of the present invention.

EXAMPLES 2, 3, 4 AND 5

Plated layers are manufactured with the same materials, and by the same method, as those of the Example 1 of the present invention, and yet those plated layers are different in thickness to the one of the Example 1. Specifically, the plated layer of the Example 2 possesses a thickness substantially at 0.4 μm, the plated layer of the Example 3 possesses a thickness substantially at 0.7 μm, the plated layer of the Example 4 possesses a thickness substantially at 1.0 μm, and the plated layer of the Example 5 possesses a thickness substantially at 5.0 μm. Soft magnetic powder materials, which are obtained as described above, are employed as test powder materials for the respective Examples 2, 3, 4 and 5.

COMPARATIVE EXAMPLE 1

An iron powder (SOMALOY550 from Höganäs) applied to the Example 1 is itself employed as a test powder material.

COMPARATIVE EXAMPLE 2

A test powder material is made from a mixture of the iron powder (SOMALOY550 from Höganäs) applied to the Example 1 and a polyamide based resin powder (average particle size 2.0 μm) at 0.6 mass % on the basis of an entire mass of the mixture.

COMPARATIVE EXAMPLE 3

A test powder material is made from the same material, and by the same method, as those of the Example 1, and yet the comparative example 3 is different from the Example 1 only to the extent that any lubricant material is not contained in the iron powder.

COMPARATIVE EXAMPLE 4

A test powder material is made from a mixture of the iron powder (SOMALOY550 from Höganäs) applied to the Example 1 and the PTFE powder also applied to the Example 1 at the same content as that of the Example 1.

COMPARATIVE EXAMPLE 5

A test powder material is made from a mixture of the iron powder (SOMALOY550 from Höganäs) applied to the Example 1, a polyamide based resin powder (average particle size 2.0 μm) at 0.3 mass % on the basis of the entire mass of the mixture, and a PPS resin material (average particle size 2.0 μm, from Polyplastics) at 0.3 μm relative thereto.

Table 1 summarizes test powder materials of each embodiment and comparative example, and explains whether a plated layer is formed, or otherwise, and whether a lubricant material is contained, or otherwise.

TABLE 1

| | Plated Layer | Lubricant Material |
|---|---|---|
| Example 1 | 0.1 μm | PTFE |
| Example 2 | 0.4 μm | PTFE |
| Example 3 | 0.7 μm | PTFE |
| Example 4 | 1.0 μm | PTFE |
| Example 5 | 5.0 μm | PTFE |

TABLE 1-continued

| | Plated Layer | Lubricant Material |
|---|---|---|
| Comparative Example 1 | Not formed | Not contained |
| Comparative Example 2 | Not formed | PA at 0.6 mass % |
| Comparative Example 3 | 0.1 μm | Not contained |
| Comparative Example 4 | Not formed | PTFE |
| Comparative Example 5 | Not formed | PA at 0.3 mass % + PPS at 0.3 mass % |

Molding Test

A possible degree of ejection force, which is necessary for eject a green compact from a die, is measured in connection with each test powder material of each Example and comparative example, the each test powder material which have been already molded. As molding conditions, each test powder material is molded by means of a die at a size of 55 mm (length)×10 mm (width ), at a degree of ejection force at 600 MPa in such a manner that each test specimen to be molded is of a substantially rectangular shaped at a size of 55 mm (length)×10 mm (width)×10 mm (thickness). FIG. 1 shows the test result for each Example and comparative example.

As is apparent from FIG. 1, with the exception of the comparative example 1, at which no lubricant material is contained in the test powder material, the test result shows that a preferable degree of ejection force can be attained in connection with each test powder material of the comparative Example 2 and the Examples 1 to 5. Moreover, the test result shows that the ejection force in terms of the test powder material of each Example 1 to 5 is substantially equivalent to that of the Comparative Example 2 (conventional art). Therefore, the test result well verifies that a degree of ejection force is less influenced by the thickness of a plated layer, and by whether a plated layer is formed on an iron powder, or otherwise.

Strength Test

Tension Test

Test pieces applied to a tension test are manufactured by use of test powder materials of the Example 1, the Comparative Examples 1, 2 and 5. Each test piece is manufactured at a degree of ejection force at 600 MPa. Each heat-treatment condition during a heat-treating process is defined for the Example 1 at a heat temperature of 500° C. for one hour, and for the Comparative Examples 1, 2 and 5 at a heat temperature of 300° C. for one hour. As aforementioned, the heat temperature of each Comparative Example is set at a temperature lower than that of the Example 1, because it has been found that a magnetic property of the test powder material of each Comparative Example remarkably drops when each test powder material is heated up at 500° C. In light of the foregoing, the test piece of each Comparative Example is subjected to a heat temperature of 300° C., at which a magnetic property of the test powder material drops at a tolerance degree.

Figure 2:
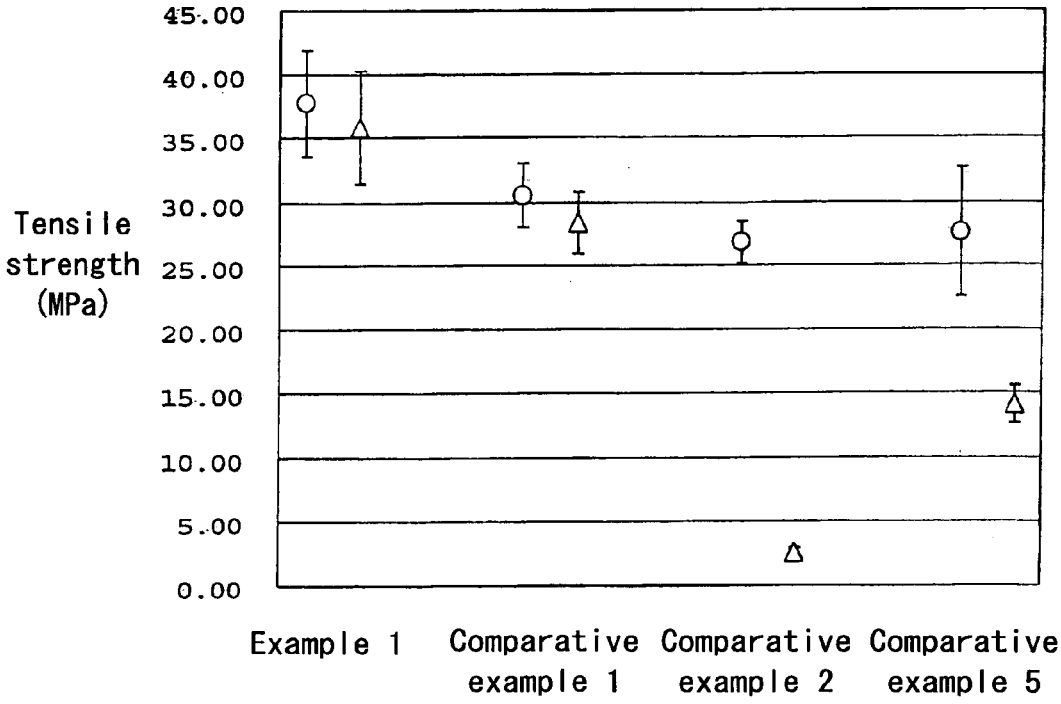
FIG. 2 is a diagram for explaining a temperature dependency of tensile strength of a soft magnetic powder compact applied with a heat treatment by Test 1 according to the embodiment of the present invention.

A shape of each test piece is designed at a shape specified in JIS2201 and JIS1998. A degree of tensile strength for each test piece is measured at each ambient temperature level, by repeatedly implementing a tension test both at a room temperature and at a temperature of 200° C. FIG. 2 shows the test result. In FIG. 2, circle means test result at a room temperature, and triangle means test result at a temperature of 200° C.

As is apparent from FIG. 2, the test piece of the Example 1 shows, at each temperature level, a degree of tensile strength greater than that of each Comparative Example. In terms of the test piece of the Comparative Example 2, a polyamide based resin (PA) contained as a lubricant material does not exert, at a temperature of 200° C., a sufficient degree of tensile strength. In terms of the test piece of the Comparative Example 5, in favor of a PPS, which possess a high heat-resisting property, contained as a part of lubricant materials, the test piece of the Comparative Example 5 shows, at a temperature of 200° C., an improved degree of tensile strength rather than that of the Comparative Example 2. However, the measured tensile strength of the Comparative Example 5 at a temperature of 200° C. does not achieve a sufficient level. In terms of the test piece of the Comparative Example 1, although the iron powder material does not contain any lubricant material therein, the lubricant material which on occasions becomes a source of decreasing a level of tensile strength, a degree of tensile strength of the Example 1 shows a superior result rather than that of the Comparative Example 1. As described above, it is possible to expect that a degree of bonding strength in a soft magnetic powder material is enhanced, under the favor of a behavior of a matrix contained in a plated layer.

Transverse Test

Test pieces applied to a transverse test are manufactured by use of test powder materials of the Examples 2, 3, 4 and the Comparative Examples 1, 3. Each test piece is manufactured at a degree of ejection force at 600 MPa. Each heat-treatment condition during a heat-treating process is defined for the Example 2, 3, and 4 at a heat temperature of 500° C. for one hour, and for the Comparative Examples 1 and 3 at a heat temperature of 300° C. for one hour. A heat temperature applied to the test piece of each Comparative Example is different from that applied to the test piece of each Example, on the basis of the same reason described above.

Figure 3:
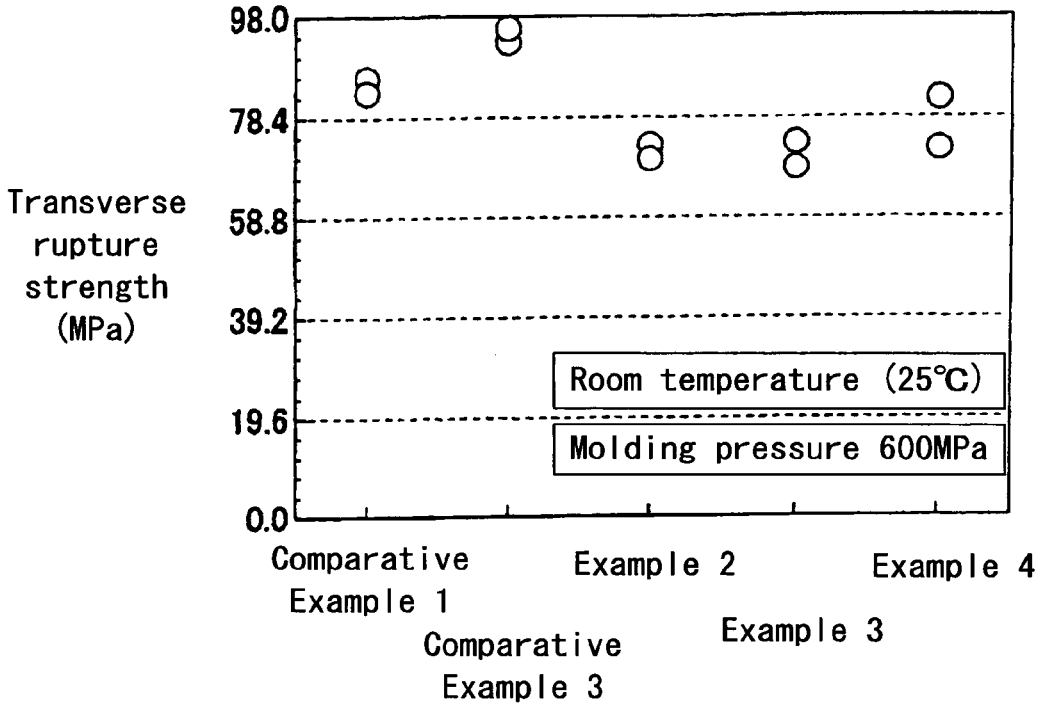
FIG. 3 is a diagram for explaining a deflecting strength of a soft magnetic powder compact applied with a heat treatment by Test 1 according to the embodiment of the present invention.

A shape of each test piece is designed at 15 mm (length)×6 mm (width)×3 mm (thickness). A degree of strength for each test piece is measured by repeatedly implementing a flexure test at a room temperature at three points of each test piece: both ends in a long direction and a central point therein. FIG. 3 shows the test result.

As is apparent from FIG. 3, it has been found that a sufficient degree of strength can be exerted in connection with each Example and Comparative Example. In consideration that, in terms of the Example and Comparative Examples which does not contain a lubricant material, it has been found that a degree of tensile strength at a room temperature is only insignificantly different from a degree of tensile strength at a temperature of 200° C., it is possible to expect for this transverse test that a degree of strength at a room temperature does not differ considerably from a degree of strength at a temperature of 200° C.

Measurement of Magnetic Property

Measurement of Magnetic Property

Figure 4:
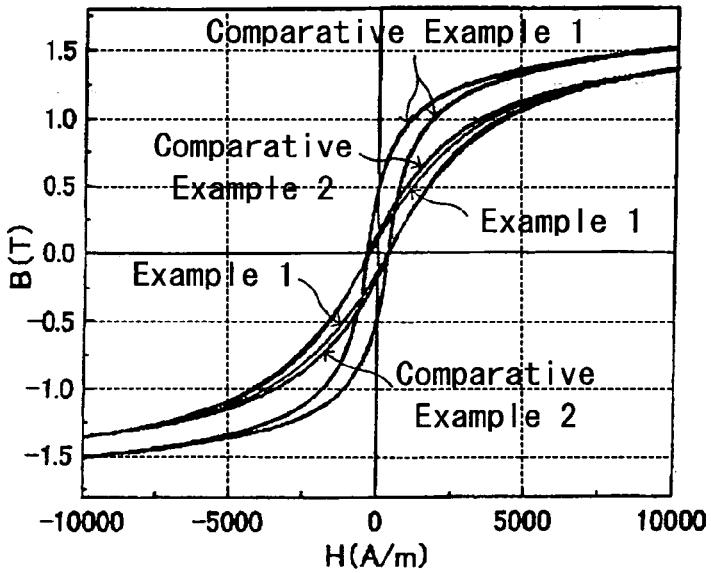
FIG. 4 is a diagram for explaining a degree of magnetic flux density of a soft magnetic powder compact applied with a heat treatment by Test 1 according to the embodiment of the present invention.

Rings for measuring a degree of magnetic property are manufactured by use of test powder materials of the Example 1, and the Comparative Examples 1 and 2. Each ring has a size of 26 mm (major diameter), 19 mm (minor diameter), and 2 mm (thickness). Each ring is manufactured at a degree of ejection force at 600 MPa. Each heat-treatment condition during a heat-treating process is defined for the Example 1 at a heat temperature of 500° C. for one hour, and for the Comparative Examples 1 and 2 at a heat temperature of 300° C. for one hour. A degree of magnetic property is measured by means of a DC magnetic property-measuring device (BH analyzer, from Riken Denshi). FIG. 4 shows the test result.

As is apparent from FIG. 4, a level of magnetic flux density of the Example 1 is lower than that of the Comparative Example 1 which does not posses a plated layer and a lubricant material, whereas, the level of magnetic flux density of the Example 1 is substantially equal to that of the Comparative Example 2 which contains a lubricant material independently in the iron powder, not as a material contained in a plated layer.

Measurement of Iron Loss

Figure 5:
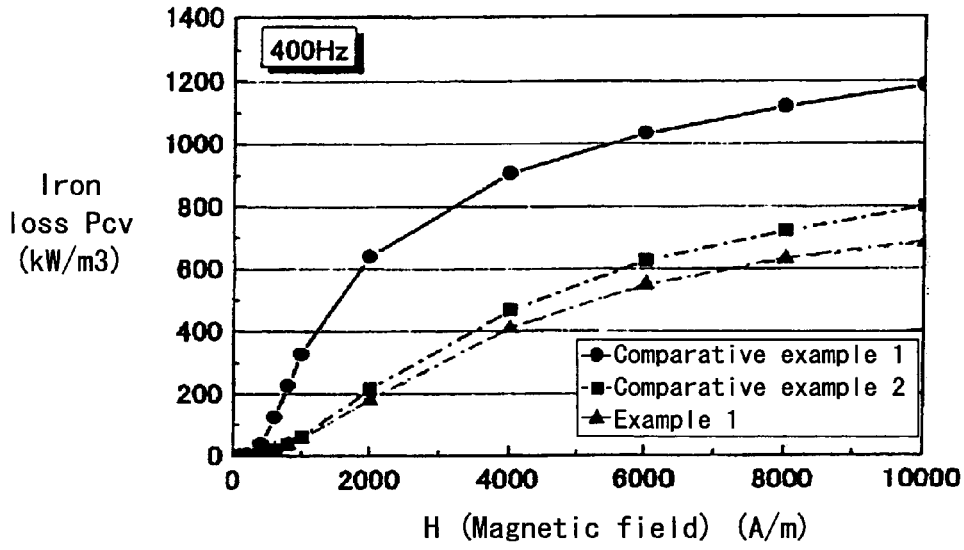
FIG. 5 is a diagram for explaining a degree of iron loss per volume of a soft magnetic powder compact applied with a heat treatment by Test 1 according to the embodiment of the present invention.

The rings applied to the measurement of magnetic property are employed so as to measure a degree of iron loss per volume, by means of an AC magnetic property-measuring device (B-H analyzer, from Iwatsu Electric Co., Ltd.) FIG. 5 shows the test result.

As is apparent from FIG. 5, it has been found that a degree of iron loss per volume of the Example 1 is less vastly from that of the Comparative Example 1 which does not contain a plated layer and a lubricant material. Moreover, the degree of iron loss per volume of the Example 1 is less from that of the Comparative Example 2 that contains a lubricant material independently in the iron powder, not as a material contained in a plated layer. It is possible to expect that an annealing effect of an iron powder can be exerted in response to possible increase in a heat-treating temperature, thereby reducing a value of iron loss.

Measurement of Specific Resistance

Figure 6:
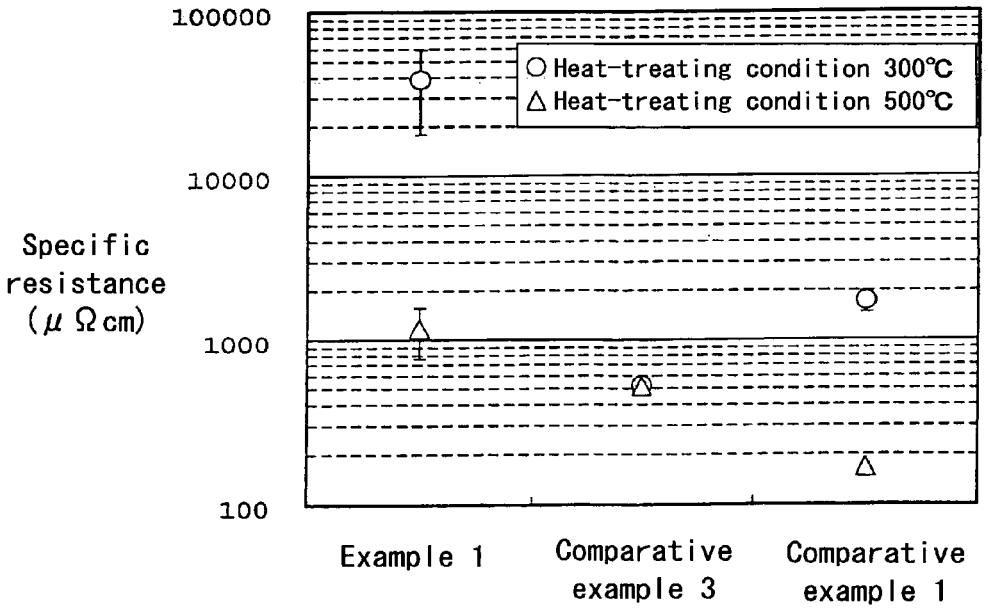
FIG. 6 is a diagram for explaining a temperature dependency of specific resistance of a soft magnetic powder compact applied with a heat treatment by Test 1 according to the embodiment of the present invention.

Test pieces are manufactured by use of test powder materials of the Example 1 and the Comparative Examples 1, 3. Each test piece is manufactured at a degree of ejection force at 588 MPa. Each heat-treatment condition during a heat-treating process is defined for the Example 1 at a heat temperature of 500° C. for one hour, and for the Comparative Examples 1 and 3 at a heat temperature of 300° C. for one hour, in such a manner that a specific resistance is measured. Each test specimen to be molded possesses a size of 20 mm (length)×9 mm (width)×3 mm (thickness). The measurement of a degree of specific resistance is implemented in a manner of a four-terminal test method. FIG. 6 shows the test result.

As is apparent from FIG. 6, it has been found that a degree of specific resistance of each Comparative Example 1 and 3 is remarkably less than that of the Example 1. Especially, the degree of specific resistance of each Comparative Example 1 and 3 is remarkably low under a condition of a heat-treatment at a temperature of 500° C. Accordingly, it may be difficult to employ the iron powder material of the Comparative Examples 1 and 3 as a soft magnetic material for this present invention.

Result

The test results have taught that a degree of ejection force for molding a green compact from a test powder material according to each Example of the present invention is substantially equal to or less than that of the Comparative Example 2, and so strength of a soft magnetic powder compact is sufficient. Moreover, the test results have taught that the test powder material according to each Example of the present invention have taught that a degree of iron loss per volume of each Example is small, and so the soft magnetic powder compact of each Example possesses an excellent degree of magnetic property.

Test 2

Manufacturing of Test Powder Material

EXAMPLE 6

A plated layer, which contains, PTFE powder (average particle size 0.2 μm) as a lubricant material, and a compound NiP as a matrix, is formed on each pure iron powder particle (average particle size 200 μm, ABX100.30 from Höganäs) as an iron based powder. The plated layer is formed by an electroless deposition method. The thickness of the plated layer is 0.1 μm, and the content of the PTFE powder is defined at substantially 20 volume % on the basis of the volume of the plated layer. A density or content of an elemental phosphorus contained in the plated layer is substantially 12 mass % on the basis of the entire mass of the plated layer. A soft magnetic powder material, which is obtained with the aforementioned material by the aforementioned method, is employed as a test powder material according to the Example 6 of the present invention.

EXAMPLE 7

A soft magnetic powder material is manufactured with the same materials and by the same method as the Example 6, and yet the soft magnetic powder material of the Example 7 is made from an iron powder (average particle size 200 μm, SOMALOY550 from Höganäs) as an iron based powder, instead of a pure iron powder. A soft magnetic powder material, which is obtained with the aforementioned material by the aforementioned method, is employed as a test powder material according to the Example 7 of the present invention. A density or content of an elemental phosphorus contained in the plated layer is substantially 12 mass % on the basis of the entire mass of the plated layer.

EXAMPLE 8

A soft magnetic powder material is manufactured with the same materials and by the same method as the Example 7, and yet a density or content of an elemental phosphorus contained in the plated layer is substantially 8 mass % on the basis of the entire mass of the plated layer. A soft magnetic powder material, which is obtained with the aforementioned material by the aforementioned method, is employed as a test powder material according to the Example 8 of the present invention.

In addition to the above Examples 6, 7 and 8, the aforementioned Comparative Examples 1 and 2 are employed as test specimens.

Table 2 summarizes test powder materials of each embodiment and comparative example, and explains whether a plated layer (a matrix) is formed, or otherwise, a content of an elemental phosphorus contained in a plated layer, and whether an insulating coating coats an iron based powder material, or otherwise.

TABLE 2

| | Plated Layer | Lubricant material | Content of Elemental Phosphorus | Insulating Coating on an Iron based Powder |
|---|---|---|---|---|
| Example 6 | 0.1 μm | PTFE | 12 | Not Coating |
| Example 7 | 0.1 μm | PTFE | 12 | Coating |
| Example 8 | 0.1 μm | PTFE | 8 | Coating |

TABLE 2-continued

| | Plated Layer | Lubricant material | Content of Elemental Phosphorus | Insulating Coating on an Iron based Powder |
|---|---|---|---|---|
| Comparative Example 1 | Not Formed | Not Contained | — | Coating |
| Comparative Example 2 | Not Formed | PA at 0.6 mass % | — | Coating |

Molding Test

Figure 7:
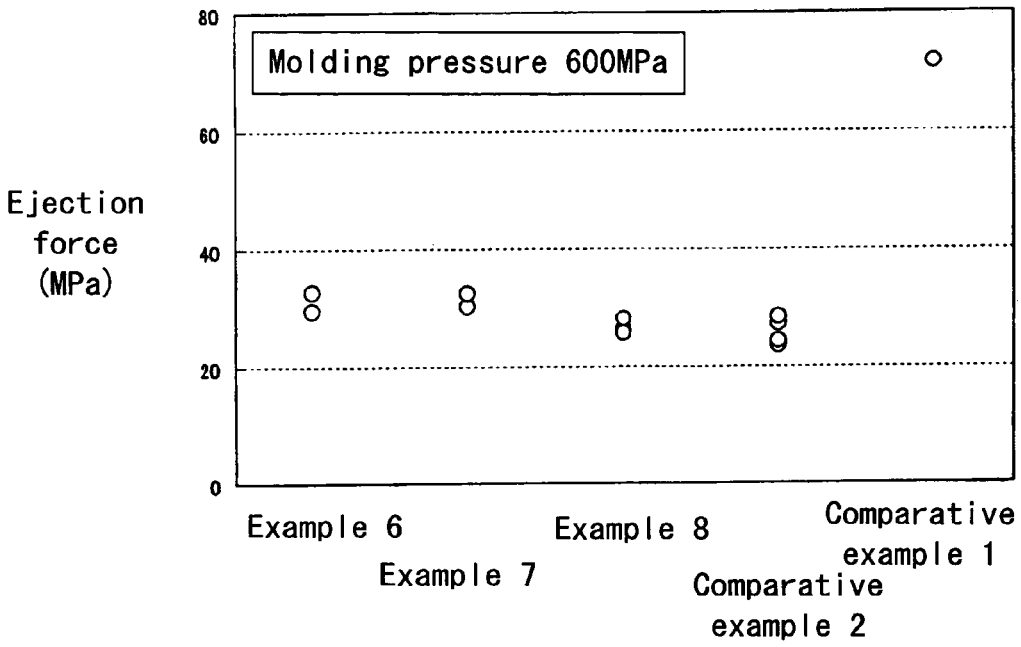
FIG. 7 is a diagram for explaining a degree of ejection force for molding a soft magnetic powder compact by Test 2 according to an embodiment of the present invention.

A possible degree of ejection force, which is necessary for eject a green compact from a die, is measured in connection with each test powder material of each Example and comparative example, the each test powder material which have been already molded. As molding conditions, each test powder material is molded by means of a die at a size of 55 mm (length)×10 mm (width ), at a degree of ejection force at 600 MPa in such a manner that each test specimen to be molded is of a substantially rectangular shaped at a size of 55 mm (length)×10 mm (width)×10 mm (thickness). FIG. 7 shows the test result for each Example and comparative example.

As is apparent from FIG. 7, with the exception of the Comparative Example 1, at which no lubricant material is contained in the test powder material, the test result shows that a preferable degree of ejection force can be attained in connection with each test powder material of the Comparative Example 2 and the Examples 6 to 8. Moreover, the test result shows that the ejection force in terms of the test powder material of each Example 6 to 8 is substantially equivalent to that of the Comparative Example 2 (conventional art). Therefore, the test result have taught that a degree of ejection force is less influenced by a density or content of an elemental phosphorus contained in a plated layer, and by whether an insulating coating coats a surface of an iron based powder particle, or otherwise.

Strength Test

Tension Test

Test pieces applied to a tension test are manufactured by use of test powder materials of the Examples 6 to 8, the Comparative Examples 1 and 2. Each test piece is manufactured at a degree of ejection force at 600 MPa. Each heat-treatment condition during a heat-treating process is defined for the Examples 6 to 8 at a heat temperature of 500° C. for one hour, and for the Comparative Examples 1 and 2 at a heat temperature of 300° C. for one hour. As aforementioned, the heat temperature of each Comparative Example is set at a temperature lower than that of the Example 1, because it has been found that a magnetic property of the test powder material of each Comparative Example remarkably drops when each test powder material is heated up at 500° C. In light of the foregoing, the test piece of each Comparative Example is subjected to a heat temperature of 300° C., at which a magnetic property of the test powder material drops at a tolerance degree.

Figure 8:
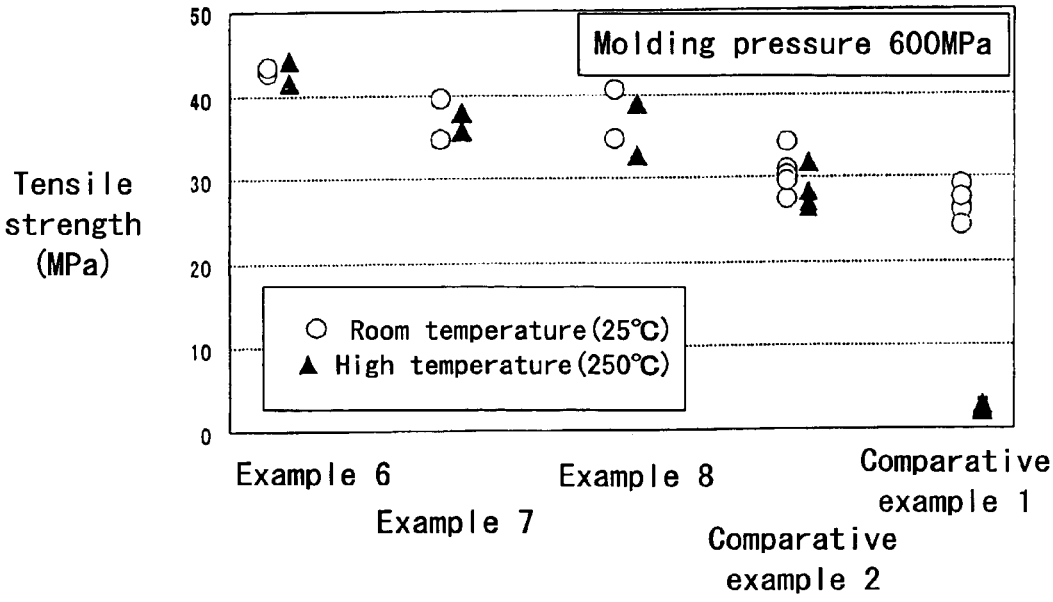
FIG. 8 is a diagram for explaining a temperature dependency of tensile strength of a soft magnetic powder compact applied with a heat treatment by Test 2 according to the embodiment of the present invention.

A shape of each test piece is designed at a shape specified in JIS2201 and JIS1998. A degree of tensile strength for each test piece is measured at each ambient temperature level, by repeatedly implementing a tension test both at a room temperature (25° C.) and at a temperature of 200° C. FIG. 8 shows the test result.

As is apparent from FIG. 8, the test piece of the Example 6 shows, at each temperature level, a degree of tensile strength greater than that of each Comparative Example. It is possible to expect that because an insulating coating does not coat a surface of each iron based powder particle, the degree of tensile strength of the Example 6 is greater than that of other Examples and Comparative Examples. The test result has taught that a degree of tensile strength of each Example 7 and 8 is slightly lower than that of the Example 6, but is greater than that of each Comparative Example 1 and 2. Therefore, it is possible to expect that a content of an elemental phosphorous contained in a plated layer does not influence much on a degree of a tensile strength.

In terms of the test piece of the Comparative Example 2, a polyamide based resin (PA) contained as a lubricant material does not exert, at a temperature of 200° C., a sufficient degree of tensile strength. In terms of the test piece of the Comparative Example 1, although the iron powder material does not contain any lubricant material therein, the lubricant material which on occasions becomes a source of decreasing a level of tensile strength, a degree of tensile strength of each Example 6 to 8 shows a superior result rather than that of the Comparative Example 1.

Measurement of Magnetic Property

Measurement of Magnetic Property

Figure 9:
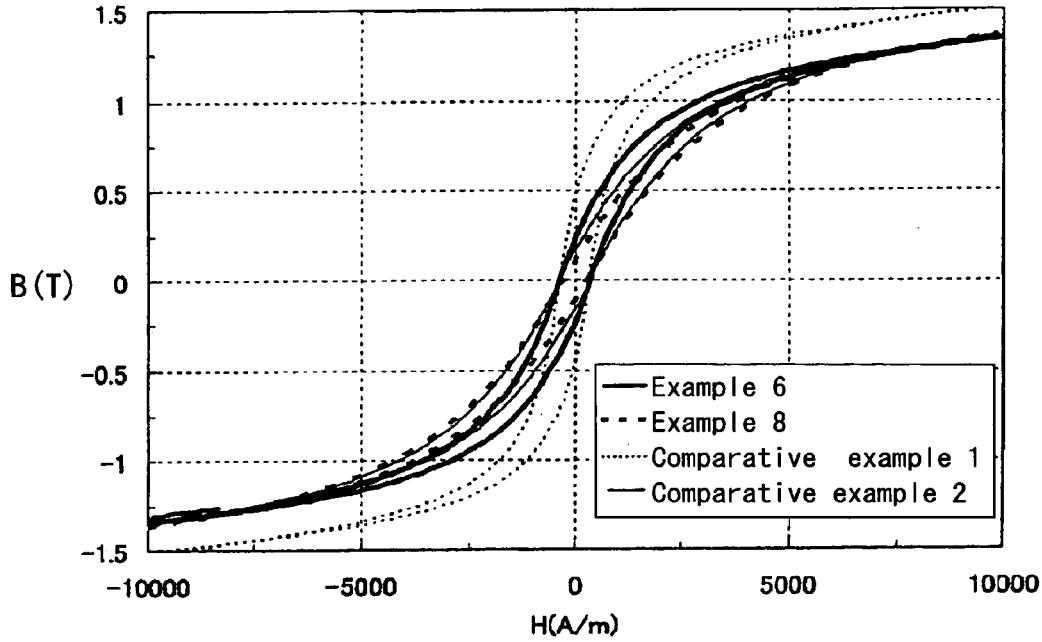
FIG. 9 is a diagram for explaining a degree of magnetic flux density of a soft magnetic powder compact applied with a heat treatment by Test 2 according to the embodiment of the present invention.

Rings for measuring a degree of magnetic property are manufactured by use of test powder materials of the Example 6 and 8, and the Comparative Examples 1 and 2. Each ring has a size of 26 mm (major diameter), 19 mm (minor diameter), and 2 mm (thickness). Each ring is manufactured at a degree of ejection force at 600 MPa. Each heat-treatment condition during a heat-treating process is defined for each Example 6 and 8 at a heat temperature of 500° C. for one hour, and for the Comparative Examples 1 and 2 at a heat temperature of 300° C. for one hour. A degree of magnetic property is measured, at a magnetic field of 10,000 A/m, by means of a DC magnetic property-measuring device (BH analyzer, from Riken Denshi). FIG. 9 shows the test result.

As is apparent from FIG. 9, a level of magnetic flux density of the Example 6 is lower than that of the Comparative Example 1 which does not posses a plated layer and a lubricant material, whereas, the level of magnetic flux density of the Example 6 is substantially equal to that of Example 8, at which an insulating coating coats a surface of an iron based powder, and to that of the Comparative Example 2 which contains a lubricant material independently in the iron powder, not as a material contained in a plated layer.

Measurement of Iron Loss

Figure 10:
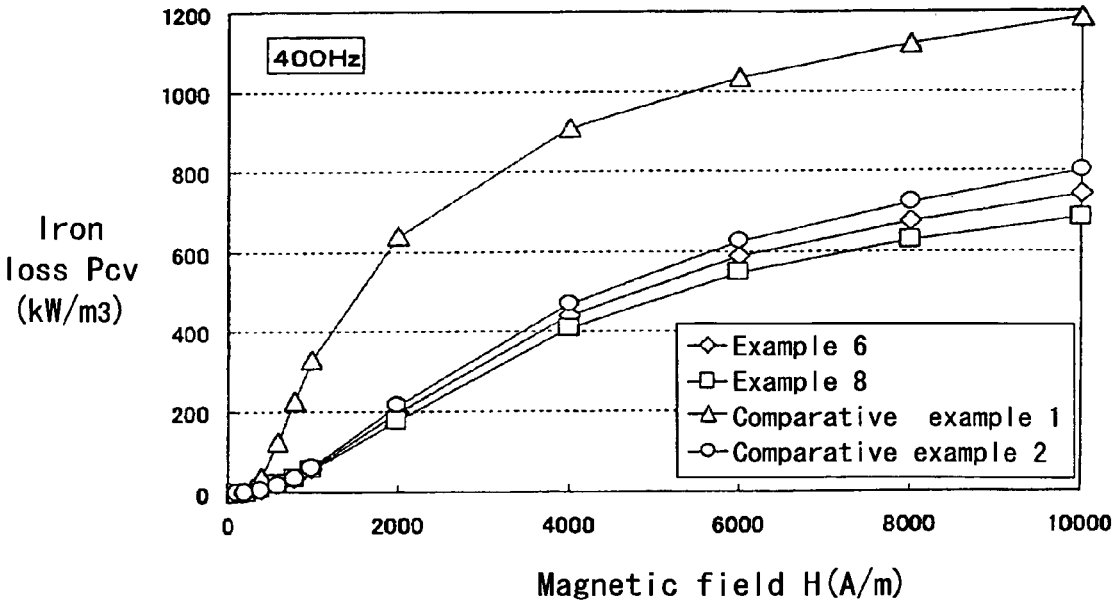
FIG. 10 is a diagram for explaining a degree of iron loss per volume of a soft magnetic powder compact applied with a heat treatment by Test 2 according to the embodiment of the present invention.

The rings applied to the measurement of magnetic property are employed so as to measure a degree of iron loss per volume, by means of an AC magnetic property-measuring device (B-H analyzer, from Iwatsu Electric Co., Ltd.) FIG. 10 shows the test result.

As is apparent from FIG. 10, it has been found that a degree of iron loss per volume of the Example 6 is less vastly from that of the Comparative Example 1 that does not contain a plated layer and a lubricant material. Moreover, the degree of iron loss per volume of the Example 6 is less from that of the Comparative Example 2 that contains a lubricant material independently in the iron powder, not as a material contained in a plated layer. Still moreover, the degree of iron loss per volume of the Example 6 is substantially the same as that of the Example 8. Therefore, it has been found that, even if it does not contain an insulating coating, a good response in terms of iron loss can be obtained by increasing a density or content of an elemental phosphorous.

Measurement of Specific Resistance

Test pieces are manufactured by use of test powder materials of the Examples 6, 8 and the Comparative Example 1. Each test piece is manufactured at a degree of ejection force at 588 MPa. Each heat-treatment condition during a heat-treating process is defined at a heat temperature of 500° C. for one hour and at a heat temperature of 300° C. for one hour, in such a manner that a specific resistance is measured. Each test specimen to be molded possesses a size of 20 mm (length)×9 mm (width)×3 mm (thickness). The measurement of a degree of specific resistance is implemented in a manner of a four-terminal test method. Degrees of specific resistance for the Example 6 are 1000 μ Ωcm at a heat-treatment temperature of 500° C., and 20000 μ Ωcm at a heat-treatment temperature of 300° C. Degrees of specific resistance for the Example 8 are 1200 μ Ωcm at a heat-treatment temperature of 500° C., and 4000 μ Ωcm at a heat-treatment temperature of 300° C. Degrees of specific resistance for the Comparative Example 1 are 150 μ Ωcm at a heat-treatment temperature of 500° C., and 1800 μΩcm at a heat-treatment temperature of 300° C.

Therefore, it has been found that a degree of specific resistance of each Comparative Example 1 is remarkably less than that of the Examples 6 and 8. It is possible to estimate that a degree of specific resistance would be 2000 μ Ωcm at a content of an elemental phosphorous of substantially 12 mass %, and 300 μ Ωcm at a content of an elemental phosphorous of substantially 8 mass %.

Result

The test results have taught that a degree of ejection force for molding a green compact from a test powder material according to the Example 6 of the present invention is greater than that of each Example 7 and 8, and so strength of a soft magnetic powder compact is sufficient. Moreover, the test results have taught that a degree of iron loss per volume is small, and so the soft magnetic powder compact possesses an excellent degree of magnetic property. That is, it has been found that a soft magnetic powder compact possesses an excellent value all in a molding property, a strength property, and a magnetic property.

As described above, by forming, on a surface of an iron powder, a plated layer having a lubricating property, it is possible to reduce an ejection force required for ejecting a green compact from a die. Moreover, because a lubricant material disperses within a plated layer, even a less amount of lubricant material can make it possible to achieve a sufficient degree of lubricating performance. Therefore, in favor of a high degree of lubricating performance, a green compact can be ejected from a die only with a low degree of an ejection force.

Moreover, in terms of a soft magnetic powder compact made from a soft magnetic powder material, because a content of the lubricant material, which does not have a positive effect on a magnetic property of the soft magnetic powder compact, is less, the soft magnetic powder compact can possess a high degree of magnetic property. Moreover, because a content of the lubricant material, which may become a source of corruption of a soft magnetic powder compact at a high-temperature ambience, can be reduced, a high degree of strength of the soft magnetic powder compact can be achieved at a high-temperature ambience.

The principles, the preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A soft magnetic powder material comprising:

an iron powder; and a plated layer formed on a surface of the iron powder; and a micro-powdered lubricating material dispersed in the plated layer.

2. A soft magnetic powder material according to claim 1, wherein the plated layer consists of a lubricant material and a matrix which disperses the lubricant material.

3. A soft magnetic powder material according to claim 2, wherein the matrix is made from an electroless deposition material selected from among NiP, NiWP, NiMoP, NiReP, NiB, NiWB, NiMoB, CoP, CoNiP, CoZnP, CoNiReP and CoB.

4. A soft magnetic powder material according to claim 3, wherein the plated layer comprises a compound selected from among NiP, NiWP, NiMoP, NiReP, CoP, CoNiP, CoZnP and CoNiReP and a phosphorus content of 10 wt % or more on the basis of an entire mass of the plated layer.

5. A soft magnetic powder material according to claim 2, wherein the lubricant material is a micro-powdered material which is made from a single compound, or from a mixture of compounds, selected from among polytetrafluoroethylene, molybdenum disulfide, boron nitride, thermoplastic resin, and graphite.

6. A soft magnetic powder material according to claim 1 manufactured by an electroless deposition process, by which a plated layer is formed by depositing, on a surface of an iron powder, at least one element building a matrix, along with the micro-powdered lubricant material.

7. A soft magnetic powder material according to claim 1, wherein the matrix is made from an electroless deposition material selected from among NiP, NiWP, NiMoP, NiReP, NiB, NiWB, NiMoB, CoP, CoNiP, CoZnP, CoNiReP and CoB.

8. A soft magnetic powder material according to claim 6, wherein the lubricant material is a micro-powdered material which is made from a single compound, or from a mixture of compounds, selected from among polytetrafluoroethylene, molybdenum disulfide, boron nitride, thermoplastic resin, and graphite.

9. A soft magnetic powder material according to claim 1, wherein a thickness of the plated layer is no greater than 20.0 μm.

10. A soft magnetic powder material according to claim 1, wherein the iron powder is made from a material selected among from Fe-Si based alloy, Fe-Si-Al based alloy, Fe-Ni based alloy and Fe-Co based alloy.

11. A soft magnetic powder material according to claim 1, wherein the lubricant material comprises PTFE.

12. A soft magnetic powder material according to claim 1, wherein phosphorus content of is from 10 to 12% on the basis of an entire mass of the plated layer.

* * * * *